US006874338B1

(12) United States Patent
Hunt et al.

(10) Patent No.: US 6,874,338 B1
(45) Date of Patent: Apr. 5, 2005

(54) HYDRAULIC PISTON LOCKING DEVICE

(76) Inventors: Michael H Hunt, 1700 2nd Avenue E, Tampa, FL (US) 33605; Preston E Smith, 1700 2nd Avenue E, Tampa, FL (US) 33605

( * ) Notice: Subject to any disclaimer, the term of this patent is extended or adjusted under 35 U.S.C. 154(b) by 0 days.

(21) Appl. No.: 10/605,451

(22) Filed: Sep. 30, 2003

(51) Int. Cl.[7] ..... E05B 73/00
(52) U.S. Cl. ..... 70/14; 70/18; 70/19; 70/181
(58) Field of Search ..... 70/18, 19, 174, 70/177, 178, 181, 197, 203–205; 92/15, 23, 27; 212/304; 180/287; 280/764.1

(56) References Cited

U.S. PATENT DOCUMENTS

| | | | | | |
|---|---|---|---|---|---|
| 1,257,322 | A | * | 2/1918 | Cunningham | 70/211 |
| 2,397,516 | A | | 4/1946 | Stewart | |
| 3,135,555 | A | | 6/1964 | Caskey | |
| 3,554,094 | A | | 1/1971 | Gross | |
| 4,043,253 | A | | 8/1977 | Albright et al. | |
| 4,122,758 | A | | 10/1978 | Bieringer et al. | |
| 4,373,851 | A | | 2/1983 | Confoey | |
| 4,417,644 | A | | 11/1983 | Brogard | |
| 4,483,564 | A | | 11/1984 | McDaniel | |
| 4,557,470 | A | | 12/1985 | Link | |
| 4,791,855 | A | | 12/1988 | Matsui | |
| 4,803,858 | A | * | 2/1989 | Parker | 70/231 |
| 4,913,254 | A | | 4/1990 | Castro et al. | |
| 4,947,705 | A | | 8/1990 | Yates et al. | |
| 4,949,661 | A | | 8/1990 | Phillips et al. | |
| 4,951,552 | A | | 8/1990 | Fox | |
| 4,981,069 | A | | 1/1991 | Matsui | |
| 5,024,303 | A | | 6/1991 | Kosloff | |
| 5,036,683 | A | * | 8/1991 | Geuvjehizian | 70/18 |
| 5,193,366 | A | * | 3/1993 | Brinkman | 70/18 |
| 5,199,344 | A | | 4/1993 | Wagner et al. | |
| 5,492,206 | A | | 2/1996 | Shieh | |
| 5,983,684 | A | | 11/1999 | Boisvert | |
| 6,273,405 | B2 | | 8/2001 | Okamoto | |
| 6,393,880 | B1 | * | 5/2002 | Vance, Sr. | 70/174 |
| 6,405,570 | B1 | | 6/2002 | Middleton et al. | |
| 6,439,005 | B1 | * | 8/2002 | Thompson | 70/18 |
| 6,520,067 | B1 | * | 2/2003 | Hunt et al. | 92/23 |

* cited by examiner

*Primary Examiner*—John B. Walsh
(74) *Attorney, Agent, or Firm*—Ronald E. Smith; Smith & Hopen, P.A.

(57) ABSTRACT

A device for locking a piston rod of a hydraulic piston and cylinder assembly in an extended condition so that mobile construction equipment or other heavy machinery cannot be driven from a job site. The locking device is placed in ensleeving relation to an extended piston rod between a proximal hydraulic cylinder and a distal bearing point to prevent retraction of the piston rod. The device has a hollow sleeve configuration formed of confronting first and second sleeve parts that are hingedly connected to one another. A first lock secures the first and second sleeve members to one another along a longitudinally extending parting line. A second lock is opposed to the first lock and prevents hinged movement of the first and second sleeve parts relative to one another even if the first lock is defeated. The device is adaptable to a variety of hydraulic piston and cylinder assemblies.

10 Claims, 3 Drawing Sheets

HYDRAULIC PISTON LOCKING DEVICE

BACKGROUND OF INVENTION

1. Field of the Invention

This invention relates, generally, to anti-theft devices. More particularly, it relates to a device that locks an extended hydraulic cylinder so that it cannot move.

2. Description of the Prior Art

Heavy machinery such as such as loaders, backhoes, skid steer loaders, crawlers, graders, articulated loaders, trenchers, dozers, and the like are typically parked on the job site throughout the course of a construction project because the effort to transport the equipment to a secure site is expensive and time-consuming. The machinery is susceptible to theft and vandalism.

Equipment theft from construction sites is a significant problem. The machinery is expensive to replace if stolen.

Devices that lock steering wheels offer little protection because such devices are easily cut off with a hacksaw or other suitable cutting tool. Other locking devices can be burned or pried off.

What is needed, then, is a locking device that is highly resistant to sawing, burning, or prying.

Buckets, blades and other attachments of heavy machinery commonly include hydraulic cylinder and piston rod assemblies. Hydraulic pressure is harnessed to retract and extend a piston rod from a hydraulic cylinder.

A steel sleeve is commonly interposed between the connection point, or bearing, at the distal end of the piston rod and the cylinder. The steel sleeve prevents retraction of the piston rod in the event of loss of hydraulic pressure, thereby preventing unintended movement of the attachment.

A steel sleeve can also be used as a locking device by placing it over the exposed piston rod. A padlock is typically employed to lock the sleeve. This prevents the sleeve from being removed and thus secures the piston rod in an extended condition.

With the rod in an extended position the attachments are secured in either a lowered or raised position, thereby hindering unauthorized movement of the heavy machinery.

Prior art hydraulic locking devices include U.S. Pat. No. 4,373,851 to Confoey that discloses a split cylindrical sleeve that encloses around the piston rod and includes extended tabs that are locked together using a padlock to prevent removal. The Confoey configuration is susceptible to having the padlock cut off using bolt cutters or broken off using extreme force.

An improved locking device that is easy to install and remove, which is durable, and which protects against theft and vandalism is needed.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for a locking device for heavy machinery that can be used at unsecured construction sites or storage areas, which can be installed and removed easily, and which is durable, is now provided in the form of a new, useful and non-obvious device.

The novel structure includes a substantially rigid, hollow sleeve made of two generally symmetrical, elongate parts that are hingedly connected to one another.

Each sleeve part is channel-shaped in transverse cross-section and has a proximal end, a distal end, a top wall, a side wall, and a bottom wall. The bottom wall of each sleeve part has a breadth less than the breadth of the top wall. Accordingly, when a first sleeve part is disposed in confronting relation to a second sleeve part, the top walls of said first and second sleeve parts abut one another and the bottom walls are spaced apart from one another.

The post of an elongate hinge member is positioned in the elongate space between said bottom walls and substantially occupies said space.

The elongate hinge is of conventional construction but is discontinuous mid-length of the hollow sleeve. Thus a first and a second part of the hinge are in axial alignment with one another but are longitudinally spaced apart from one another. The space between the first and second hinge parts is provided to accommodate a second or auxiliary sleeve-locking means that backs up a primary sleeve-locking means.

Each part of the hinge includes a first plurality of equidistantly and longitudinally spaced apart cylindrical inboard parts that slidingly, rotatingly, and collectively receive a hinge post. A first flat plate outboard part formed integrally with said inboard parts is fixedly secured to a bottom wall of the first sleeve part in overlying relation thereto.

Each part of the hinge includes a second plurality of equidistantly and longitudinally spaced apart cylindrical inboard parts that are interleaved with and in axial alignment with the first plurality of cylindrical inboard parts and which also collectively receive said hinge post. A second flat plate outboard part formed integrally with said second plurality of cylindrical inboard parts is fixedly secured to a bottom wall of the second sleeve part in overlying relation thereto.

The second part of the hinge has the same construction.

The first and second sleeve parts are thus hingedly connected to one another along their respective bottom walls. When the hinge is fully closed, the respective edges of the top walls of the first and second sleeve parts abut one another and the assembly is adapted to form an enclosure about an extended hydraulic piston rod.

A half flange is formed at the proximal end of each sleeve part so that when the hinge is fully closed, a full flange is formed at said proximal end. The flange abuts the distal end of a hydraulic cylinder.

A first reinforcing band is fixedly secured to the distal end of the first sleeve part. The distal edge of said first reinforcing band is flush with the distal end of said first sleeve part.

A second reinforcing band is fixedly secured to the distal end of the second sleeve part. The distal edge of said second reinforcing band is flush with the distal end of said second sleeve part.

The first and second reinforcing bands perform the function of dissipating stress loads concentrated at the respective distal ends of said first and second sleeve parts.

A first centrally apertured lock lug is secured to or formed integrally with the first sleeve part, mid-length thereof, in upstanding relation relative to said top wall of said first sleeve part. Said first lock lug is positioned on the inboard edge of said first sleeve part top wall.

A second centrally apertured lock lug is secured to or formed integrally with the second sleeve part, mid-length thereof, in upstanding relation relative to said top wall of said second sleeve part. Said second lock lug is positioned on the inboard edge of said second sleeve part top wall, in confronting relation to said first lock lug. The respective apertures formed in said first and second lock lugs are therefore in alignment with one another.

A first semicircular wall of uniform height is mounted to said first top wall, mid-length thereof and in upstanding relation thereto, in half-encircling relation to said first lock lug.

A second semicircular wall of non-uniform height is mounted to said second top wall, mid-length thereof and in upstanding relation thereto, in half-encircling relation to said second lock lug. A semicircular cut-away is formed in an outboard end of said second semicircular wall. The cut-away is formed in the bight region of said second semicircular wall and provides a clearance space.

The first lock lug integral with the first sleeve part and the second lock lug integral with the second sleeve part are secured to one another by a commercially available shackleless locking means with a hidden pin assembly or other suitable locking means.

A second locking means is formed in the novel apparatus on the opposite, bottom side thereof. A first transversely disposed, centrally apertured lock lug is secured to or formed integrally with the bottom wall of the first sleeve part, mid-length thereof. A plane that longitudinally bisects the apparatus into the first sleeve part and the second sleeve part bisects the first bottom wall lock lug.

Similarly, a second transversely disposed, centrally apertured lock lug is secured to or formed integrally with the bottom wall of the second sleeve part, mid-length thereof. Said plane also bisects said second bottom wall lock lug.

A first transversely extending slot is formed in the second sleeve part to accommodate the first bottom lock lug when the hollow sleeve is swung open about its hinge, and a second transversely extending slot is formed in the first sleeve part to accommodate the second bottom lock lug when said hollow sleeve is swung open about said hinge.

A shackleless locking means with a hidden pin assembly or other suitable locking means is employed to join the first and second bottom lock lugs together by extending the pin of a shackleless locking means through the confronting central apertures formed in said first and second bottom lock lugs. The bottom lock may also be secured by extending the shackles of a conventional lock having shackles through said confronting apertures.

In this way, the hollow sleeve is locked with two opposed locking means, both of which must be defeated before the hollow sleeve may be swung open about said elongate hinge.

An important object of the present invention is to provide an improved locking device for use with heavy machinery that prevents the movement of a hydraulic piston rod and thus prevents the theft of the machinery.

Another object is to provide a means for attaching the locking device in a proper, functional location without undue effort so that the locking device may be easily installed and removed as needed.

Another object is to provide a locking device suitable for several different heavy machines without modification.

Another object is to provide a durable locking device that and can withstand multiple unauthorized removal attempts.

These and other important objects, advantages, and features of the invention will become clear as this description proceeds.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
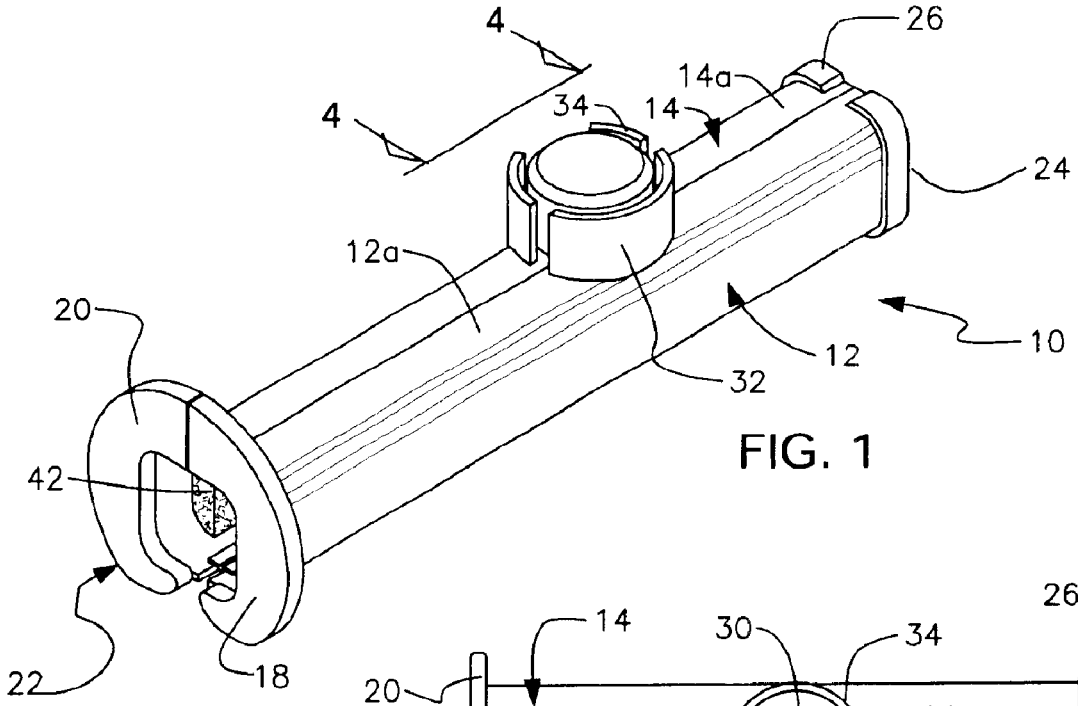
FIG. 1 is a perspective view of the novel locking device in its fully closed and locked configuration position.
Figure 2:
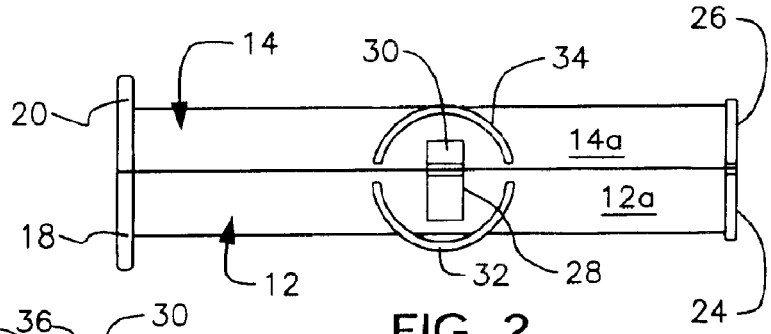
FIG. 2 is a top plan view thereof.

Referring now to FIGS. 1 and 2, it will there be seen that the reference numeral 10 denotes the novel locking device as a whole. Device 10 will be known commercially as the SleevLock™ theft-deterrent apparatus or locking device.

Locking device 10 includes first sleeve part 12 and second sleeve part 14. Each of said sleeve parts is channel shaped so that when said parts are positioned in confronting relation to one another, they collectively form a hollow sleeve. Although both sleeve parts are depicted as having a generally square "U" shape in transverse cross-section so that they collectively form an elongate square sleeve when disposed in confronting relation to one another, each of said sleeve parts could also have a semi-circular shape in transverse cross-section so that they collectively form a cylinder when so disposed. Nor is the invention limited to hollow sleeves of square or cylindrical cross-section; a machine designer of ordinary skill may select numerous other operable shapes and all such other shapes are within the scope of this invention.

Figure 3:
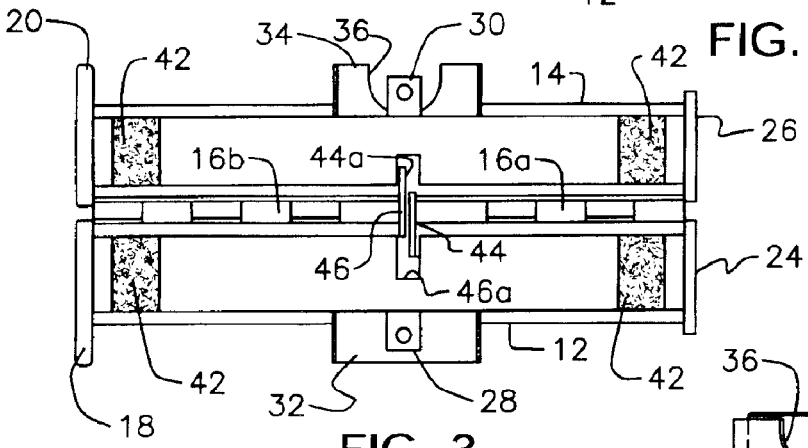
FIG. 3 is top view thereof when in an unlocked and open configuration.
Figure 6:
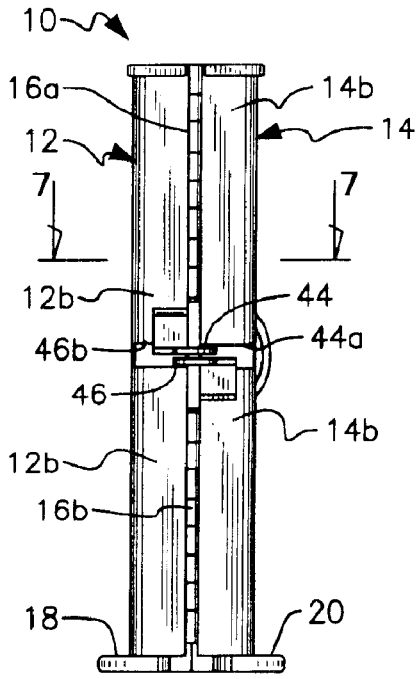
FIG. 6 is a rear elevational view thereof when in its fully closed and locked configuration.

As best understood in connection with FIGS. 3 and 6, longitudinally extending hinge members 16*a* and 16*b* hingedly interconnect first sleeve part 12 and second sleeve part 14 to one another. Said hinge members are in axial alignment with one another but are discontinuous relative to one another as best depicted in FIG. 6.

Hinges 16*a* and 16*b* have a common, conventional construction including a first and a second plurality of equidistantly and longitudinally spaced apart, axially aligned, interleaved cylindrical inboard parts that slidingly, rotatingly, and collectively receive a common hinge post in a well-known way.

More particularly, hinge 16*a* includes a first flat outboard plate 17*a* formed integrally with said first plurality of cylindrical inboard parts. Flat plate 17*a* is fixedly secured to an interior surface of bottom wall 12*b* of first sleeve 12 part in overlying relation thereto as perhaps best depicted in FIGS. 7 and 8.

Hinge 16*a* further includes a second flat outboard plate 17*b* formed integrally with said second plurality of cylindrical inboard parts. Flat plate 17*b* is fixedly secured to an interior surface of bottom wall 14*b* of second sleeve part 14 in overlying relation thereto also as depicted in FIGS. 7 and 8.

Hinge 16*b* has the same construction as aforesaid.

Figure 7:
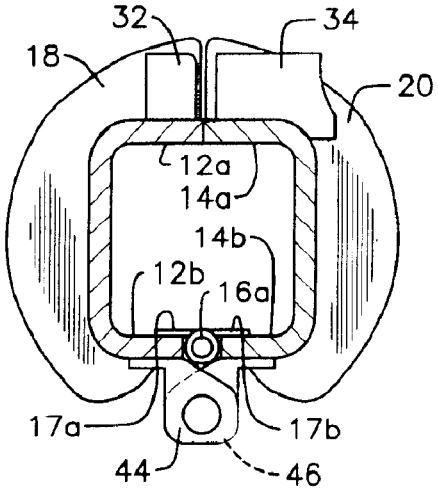
FIG. 7 is a sectional view taken along line 7—7 in FIG. 6.
Figure 8:
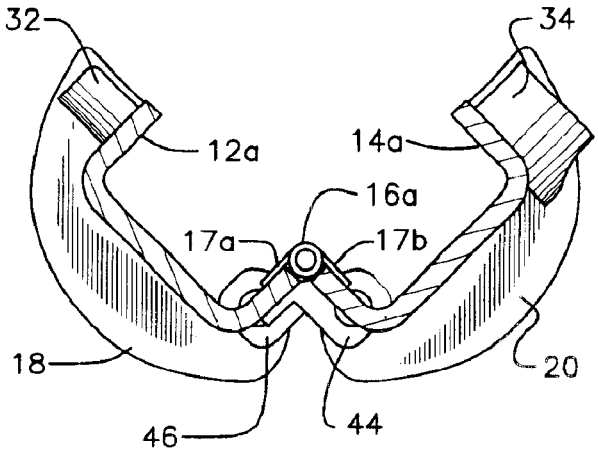
FIG. 8 is a view like FIG. 7 but depicting the novel locking apparatus in an open configuration.

The longitudinally extending space occupied at least in part by hinge members 16*a* and 16*b* is created because top wall 12*a* of sleeve part 12 and top wall 14*a* of sleeve part 14 have a greater transverse extent than bottom wall 12*b* of sleeve part 12 and bottom wall 14*b* of sleeve part 14, as perhaps best understood in connection with FIG. 7. When novel locking device 10 is in its fully closed configuration, the confronting edges of top walls 12*a* and 14*a* abut one another and the confronting edges of bottom walls 12*b*, 14*b* are spaced apart from one another by a space sufficient to receive said elongate hinge members 16*a* and 16*b*.

Half flange 18 is formed at the proximal end of sleeve part 12 and half flange 20 is formed at the proximal end of sleeve part 14 so that when the hinge is fully closed, a full flange 22 is formed at said proximal end as depicted in FIG. 1. Flange 22 abuts the distal end of a hydraulic cylinder when the novel locking device is in use.

First reinforcing band 24 is fixedly secured to the distal end of first sleeve part 12. The distal edge of said first reinforcing band is flush with the distal end of said first sleeve part.

Second reinforcing band 26 is fixedly secured to the distal end of second sleeve part 14. The distal edge of said second reinforcing band is flush with the distal end of said second sleeve part.

First and second reinforcing bands 24 and 26 perform the function of dissipating stress loads concentrated at the respective distal ends of said first and second sleeve parts, i.e., the interface between locking means 10 and the load-bearing region where the hydraulic cylinder bears against the part or parts controlled thereby.

First centrally apertured lock lug 28 is secured to or formed integrally with first sleeve part 12, mid-length thereof, in upstanding relation relative to top wall 12*a* on the inboard edge of said top wall 12*a*.

Second centrally apertured lock lug 30 is secured to or formed integrally with second sleeve part 14, mid-length thereof, in upstanding relation relative to top wall 14*a* on the inboard edge of said top wall 14*a*, in confronting relation to first lock lug 28 when locking device 10 is in its fully closed configuration. The respective central apertures formed in said first and second lock lugs, which are depicted but unnumbered to avoid cluttering the drawings, are in cooperative alignment with one another when said locking device is in said fully closed configuration.

First semicircular wall 32 of uniform height is mounted to top wall 12*a*, mid-length thereof and in upstanding relation thereto, in half-encircling relation to first lock lug 28.

Figure 4:
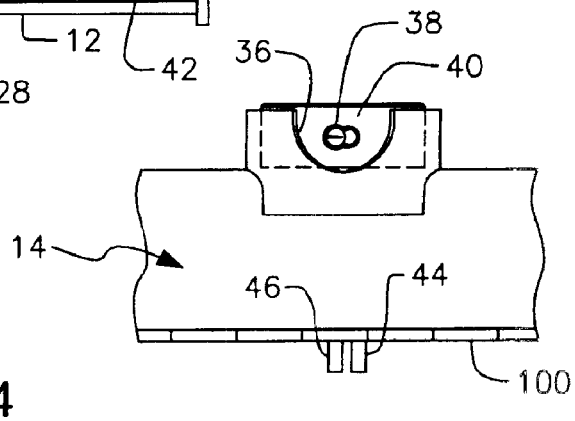
FIG. 4 is a detailed side elevational view thereof.

Second semicircular wall 34 of non-uniform height is mounted to second top wall 14*a*, mid-length thereof and in upstanding relation thereto, in half-encircling relation to second lock lug. 30 A semicircular cut-away 36 is formed in the bight region of said second semicircular wall and provides a clearance space so that a key, not shown, may access keyhole 38 (FIG. 4) to enable an authorized user to lock and unlock shackleless locking member 40 (also depicted in FIG. 4).

It should be understood that shackleless locking member 40 includes a hidden pin that extends through the central apertures formed in first and second lock lugs 28, 30 when said lock lugs are in confronting relation to one another, i.e., when locking device 10 is in its fully closed configuration.

A plurality of resilient pads, collectively denoted 42, are positioned within each sleeve part 12, 14, at opposite ends thereof to protect an extended hydraulic piston rod from damage and to provide a secure fit of locking device 10 around said piston rod when the locking device is in its fully closed and locked configuration.

A second locking means is formed in novel locking device 10 on the opposite, bottom side thereof.

Said second locking means includes a first centrally apertured lock lug 44 secured to or formed integrally with bottom wall 12*b* of first sleeve part 12, mid-length thereof and a second centrally apertured lock lug 46 secured to or formed integrally with bottom wall 14*b* of second sleeve part 14, mid-length thereof.

As perhaps best understood in FIG. 4, first and second lock lugs 44 and 46 are disposed in parallel, confronting relation to one another when locking device 10 is in its fully closed configuration. Both of said lock lugs are disposed transversely to a longitudinal axis of locking device 10.

First transversely extending slot 44*a* formed in second sleeve part 14 to accommodate first bottom lock lug 44 when hollow sleeve 10 is swung open about its hinge. Second transversely extending slot 46*a* is formed in first sleeve part 12 to accommodate second bottom lock lug 46 when said hollow sleeve is swung open about said hinge.

Figure 5:
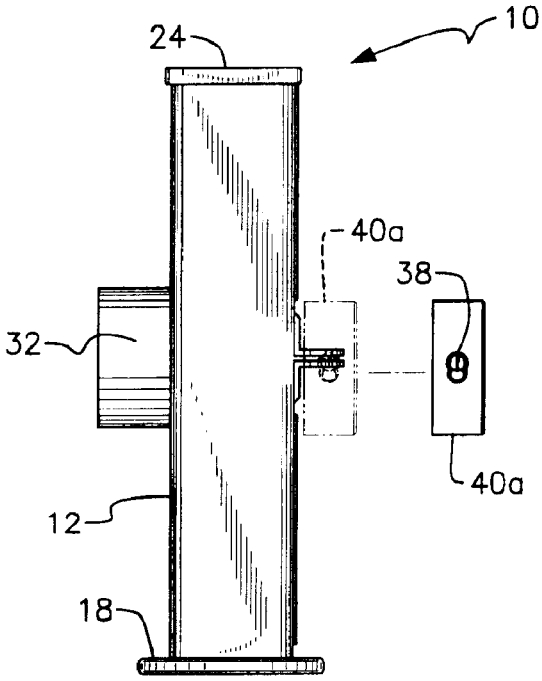
FIG. 5 is a side elevational view of the novel locking apparatus when in its fully closed and locked configuration.

Shackleless locking means 40*a* having keyhole 38*a* and a hidden pin (FIG. 5) is employed to join first and second bottom lock lugs 44, 46 together by extending the pin through the confronting central apertures formed in said first and second bottom lock lugs. The bottom lock may also be secured by extending the shackles of a conventional lock having shackles through said confronting apertures.

Figure 9:
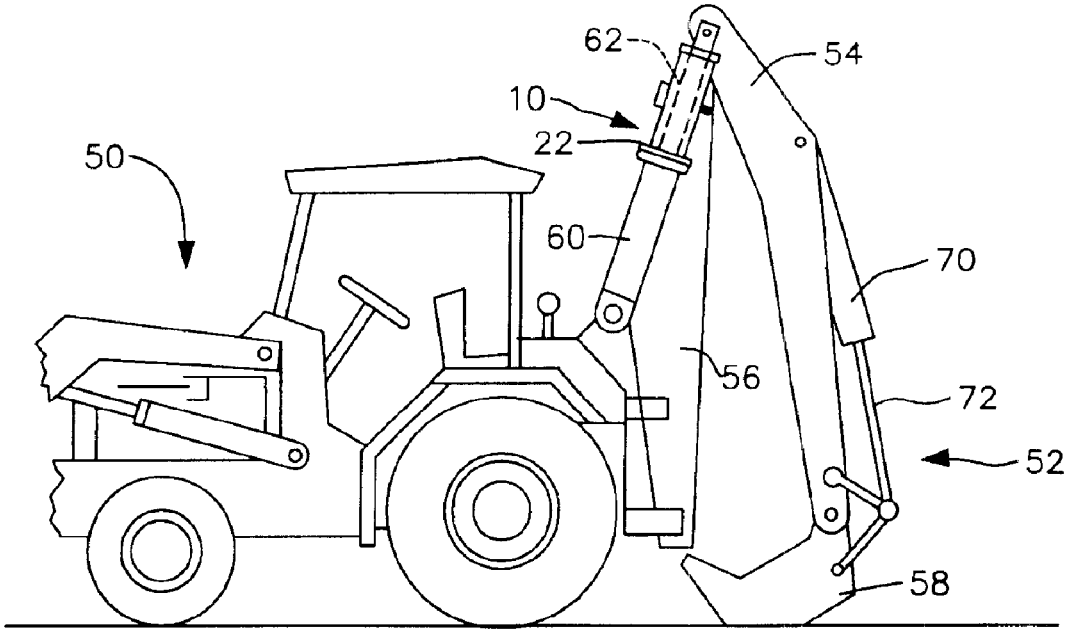
FIG. 9 is a side elevational view depicting the novel locking apparatus when positioned in operative relation to a backhoe equipped tractor.

FIG. 9 depicts locking device 10 installed on tractor 50 having backhoe attachment 52 that includes a pair of booms 54, 56 and a bucket 58 pivotally connected to one another. Boom 56 is under the control of hydraulic piston and cylinder assembly 60. Piston rod 62 of first boom 56 is shown in an extended position and device 10 is depicted in a closed and locked position encircling said piston rod 62. Flange 22 is disposed in abutting relation to hydraulic cylinder 60 and has a diameter greater than said hydraulic cylinder 60 where the opposing end of locking device 10 abuts boom 54. Thus, any hydraulic force generated by an attempt to retract piston rod 62 into cylinder 60 when locking device 10 is installed is distributed to the outer cylinder wall thereby decreasing the potential for damage to the mechanical capabilities of attachment 52 during a theft or vandalism attempt.

With locking device 10 in place, boom 54 and bucket 58 cannot be raised from the ground and tractor 10 cannot be moved.

A second locking device may be installed on hydraulic piston and cylinder assembly 70 if desired for additional security protection. However, placing locking device 10 solely on second piston rod 72 would not provide the desired security protection to prevent bucket 58 from being raised.

Figure 10:
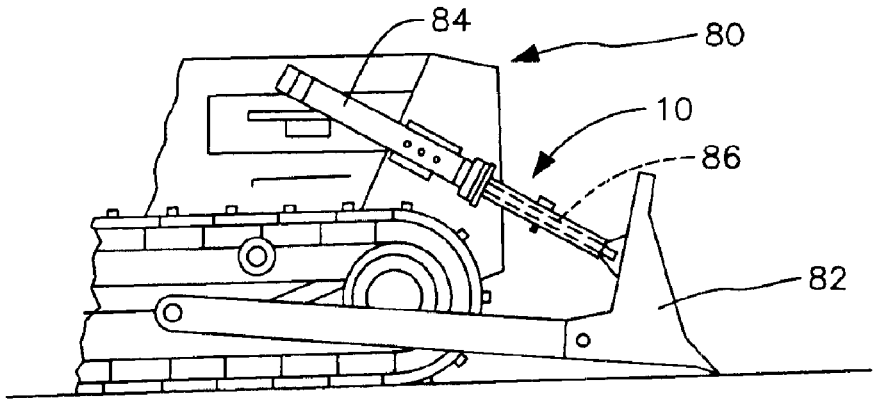
FIG. 10 is front view of the novel locking apparatus when positioned in operative relation to a bulldozer.

FIG. 10 partially depicts bulldozer 80 having blade attachment 82. Blade 82 is pivotally attached to bulldozer 80 and is under the control of hydraulic piston and cylinder assembly 84. Piston rod 86 of cylinder 84 is in an extended position and device 10 is depicted in its fully closed and locked position encircling rod 86. Annular flange 22 is disposed in abutting relation to cylinder 84 and has a diameter greater than cylinder 84 where the opposing end of locking device 10 abuts blade 82. Similar to backhoe attachment 52 depicted in FIG. 9, any hydraulic force generated by an attempt to retract piston rod 86 into cylinder 84 is distributed to the outer cylinder wall thus decreasing the potential for damage to the mechanical capabilities of blade 82 during a theft or vandalism attempt.

Accordingly, when locking device 10 is in its functional configuration, blade 82 cannot be raised from the ground and bulldozer 80 cannot be moved.

The locking device is easily installed and is easily removed by authorized personnel. The locking device is durable and withstands multiple unauthorized removal attempts. It is suitable for use with any heavy machine having a hydraulic cylinder. Moreover, locking device can be manufactured to any desired length or diameter to fit hydraulic cylinders of differing sizes.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

What is claimed is:

1. A locking device, comprising:

an elongate, rigid hollow sleeve collectively formed by a first sleeve part and a second sleeve part that confront one another along a top parting line and a bottom parting line when said rigid hollow sleeve is in a closed configuration;

an elongate hinge means for hingedly interconnecting said first sleeve part and said second sleeve part to one another along said bottom parting line;

said elongate hinge means including an elongate hinge post;

said first and second sleeve part abuttingly engaging one another along said top parting line when said rigid hollow sleeve is in said closed configuration;

a first locking means that secures together said first and second sleeve parts along said top parting line when said rind hollow sleeve is in said closed configuration; and a second locking means that prevents hinged motion between said first and second sleeve parts along said bottom parting line when said rigid hollow sleeve is in said closed configuration;

said second locking means including a first bottom lock lug formed integrally with said first sleeve and a second bottom lock lug formed integrally with said second sleeve;

a first transversely extending slot formed in said second sleeve to accommodate said first bottom lock lug when said rigid hollow sleeve is in an open configuration; and a second transversely extending slot formed in said first sleeve to accommodate said second bottom lock lug when said rigid hollow sleeve is in said open configuration;

whereby said second locking means prevents hinged motion between said first and second parts when said rigid hollow sleeve is in said closed configuration even if said first locking means is rendered non-functional.

2. The locking device of claim 1, further comprising:

said first sleeve part being channel-shaped in transverse cross-section;

said first sleeve part having a proximal end, a distal end, a top wall, a side wall, and a bottom wall;

said bottom wall of said first sleeve part having a breadth less than the breadth of said top wall of said first sleeve part;

said second sleeve part being channel-shaped in transverse cross-section;

said second sleeve part having a proximal end, a distal end, a top wall, a side wall, and a bottom wall;

said bottom wall of said second sleeve part having a breadth less than the breadth of said top wall of said second sleeve part;

said respective top walls of said first and second sleeve parts abutting one another when said first sleeve part is disposed in confronting relation to said second sleeve part;

an elongate space formed between said respective bottom walls of said first and second sleeve parts when said first sleeve part is disposed in confronting relation to said second sleeve part; and said elongate hinge post that forms a part of said elongate hinge means being disposed in said elongate space.

3. The locking device of claim 2, further comprising:

said elongate hinge means being discontinuous mid-length of said hollow sleeve to accommodate said second lock means;

said discontinuous elongate hinge means having a first part and a second part in axially aligned, longitudinally spaced apart relation with one another.

4. The locking device of claim 3, further comprising:

said first part of said elongate hinge means including a first plurality of equidistantly and longitudinally spaced apart cylindrical inboard parts that slidingly, rotatingly, and collectively receive said elongate hinge post;

said first part of said elongate hinge means further including a first flat plate outboard part formed integrally with said cylindrical inboard parts;

said first flat plate being fixedly secured to said bottom wall of said first sleeve part in overlying relation thereto;

said first part of said elongate hinge means further including a second plurality of equidistantly and longitudinally spaced apart cylindrical inboard parts that are interleaved with and in axial alignment with the first plurality of cylindrical inboard parts and which also collectively receive said elongate hinge post;

said first part of said elongate hinge means further including a second flat plate outboard pan formed integrally with said second plurality of cylindrical inboard parts, said second flat plate being fixedly secured to said bottom wall of said second sleeve part in overlying relation thereto.

5. The locking device of claim 4, further comprising:

said second part of said elongate hinge means including a first plurality of equidistantly and longitudinally spaced apart cylindrical inboard parts that slidingly, rotatingly, and collectively receive said elongate hinge post;

said second part of said elongate hinge means further including a first flat plate outboard part formed integrally with said first plurality of cylindrical inboard parts;

said first flat plate being fixedly secured to said bottom wall of said first sleeve part in overlying relation thereto;

said second part of said elongate hinge means further including a second plurality of equidistantly and longitudinally spaced apart cylindrical inboard parts that are interleaved with and in axial alignment with the first plurality of cylindrical inboard parts of said second part of said elongate hinge means and which also collectively receive said elongate hinge post;

said second part of said elongate hinge means further including a second flat plate outboard part formed integrally with said second plurality of cylindrical inboard parts of said second part of said elongate hinge means, said second flat plate being fixedly secured to said bottom wall of said second sleeve part of said second part of said elongate hinge means in overlying relation thereto.

6. The locking device of claim 2, further comprising:

a first half flange formed at the proximal end of said first sleeve part;

a second half flange formed at the proximal end of said second sleeve part;

a full flange being formed by said first and second half flanges when said first and second sleeve parts are disposed in confronting relation tone another.

7. The locking device of claim 2, further comprising:

a first reinforcing band fixedly secured to a distal end of said first sleeve part;

a distal edge of said first reinforcing band being flush with said distal end of said first sleeve part;

a second reinforcing band fixedly secured to a distal end of said second sleeve part;

a distal edge of said second reinforcing band being flush with said distal end of said second sleeve part;

said first and second reinforcing bands performing the function of dissipating stress loads concentrated at respective distal ends of said first and second sleeve parts.

8. The locking device of claim 1, further comprising:

said first locking means including a first centrally apertured top lock lug secured to said first sleeve part, mid-length thereof, in upstanding relation relative to said top wall of said first sleeve part;

said first top lock lug being positioned on an inboard edge of said first sleeve part top wall;

said first locking means further including a second centrally apertured top lock lug secured to said second sleeve part, mid-length thereof, in upstanding relation relative to said top wall of said second sleeve part;

said second top lock lug being positioned on an inboard edge of said second sleeve part top wall, in confronting relation to said first top lock lug;

said respective apertures formed in said first and second top lock lugs being disposed in alignment with one another when said first and second top lock lugs are disposed in confronting relation to one another.

9. The locking device of claim 8, further comprising:

a first semicircular wall of uniform height mounted to said first top wall, mid-length thereof and in upstanding relation thereto, in half-encircling relation to said first top lock lug;

a second semicircular wall of non-uniform height mounted to said second top wall, mid-length thereof and in upstanding relation thereto, in half-encircling relation to said second top lock lug;

a semicircular cut-away formed in a bight region of said second semicircular wall;

said semicircular cut-away providing a clearance space;

said first top lock lug and said second top lock lug adapted to be secured to one another by a shackleless locking means having a hidden pin assembly.

10. The locking device of claim 1, further comprising:

a first pair of resilient pads disposed in said first sleeve part at opposite ends thereof to cushion said piston rod, to protect said piston rod from damage, and to ensure that said locking device fits snugly around said piston rod; and a second pair of resilient pads disposed in said second sleeve part at opposite ends thereof to cushion said piston rod, to protect said piston rod from damage, and to ensure that said locking device fits snugly around said piston rod.

* * * * *